United States Patent [19]

Nilsson

[11] 4,220,093

[45] Sep. 2, 1980

[54] ELECTROMAGNETIC PROXIMITY FUZE

[75] Inventor: Ake Nilsson, Karlskoga, Sweden

[73] Assignee: Aktiebolaget Bofors, Bofors, Sweden

[21] Appl. No.: 909,237

[22] Filed: May 24, 1978

[30] Foreign Application Priority Data

May 26, 1977 [SE] Sweden ..... 7706158

[51] Int. Cl.[3] ..... F42C 13/08

[52] U.S. Cl. ..... 102/212

[58] Field of Search ..... 102/212

[56] References Cited

U.S. PATENT DOCUMENTS

| | | | |
|---|---|---|---|
| 2,514,359 | 7/1950 | Allison | 102/212 |
| 2,959,128 | 11/1960 | Boykin | 102/212 |
| 3,001,476 | 9/1961 | Boykin | 102/212 |
| 3,026,805 | 3/1962 | Becker | 102/212 |

*Primary Examiner*—Charles T. Jordan

*Attorney, Agent, or Firm*—Pollock, Vande Sande & Priddy

[57] ABSTRACT

An electromagnetic proximity fuze is utilized to initiate the detonation of a charge in a projectile when the projectile approaches within a particular triggering distance of an electrically conducting target object. A transmitter is disposed in the nose section of the projectile to generate an alternating electromagnetic field in response to a transmitter signal. A receiver is disposed in front of the transmitter in a spaced relation to the transmitter. The alternating electromagnetic field of the transmitter directly induces an electromotive force in the receiver. The electromagnetic field of the transmitter also extends to interact with the electrically conducting target object to cause the object to generate an electromagnetic field that induces an interference electromotive force in the receiver. Signal processing means are provided to separate the interference electromotive force from the directly induced electromotive force and to emit an emission signal for initiating the detonation of the charge in response to the interference electromotive force.

9 Claims, 3 Drawing Figures

ELECTROMAGNETIC PROXIMITY FUZE

The present invention relates to an electromagnetic proximity fuze for initiating the charge of a charge carrier, for instance a missile, projectile, shell, or the like, when is at a certain distance from a metallic object.

Most of the previously known proximity fuzes utilize electromagnetic waves, e.g. radar proximity fuzes, IR proximity fuzes and optical proximity fuzes. However, it is also previously known to use magnetically acting proximity fuzes, then utilizing the situation that the earth-magnetic field is deformed around an object which is built up of iron. The proximity fuze comprises a sensing system in the form of coils, in which an electromotive force is induced when the magnetic field through the coils is changed. When a charge carrier with a magnetically acting proximity fuze passes a target which contains iron parts, the induced electromotive force gives rise to a current in the sensing system which can be utilized as an ignition pulse for initiating the warhead of the charge carrier. Due to the comparatively small changes in the earth-magnetic field it has not been possible, in practice, to utilize the abovementioned principle for proximity fuzes which are to act at an exactly defined distance from the target.

The purpose of the present invention is therefore to achieve an electromagnetic proximity fuze for initiating the charge of a charge carrier only when a metallic object is at an exactly defined distance from the charge carrier, particularly such a small distance as 0.5–1.5 m. A further purpose is to achieve an electromagnetic proximity fuze which acts independent of the earth-magnetic field and independent of whether or not the target is built up of iron.

The invention is then mainly characterized in that the proximity fuze comprises a transmitter unit for generating an electromagnetic field, a receiver unit in which there is induced an electromotive force under the direct influence of said electromagnetic field and also an interference electromotive force under the influence of the field generated by the metallic object and signal processing means arranged to separate the interference electromotive force from the directly induced electromotive force and to emit an active signal in dependence on said interference electromotive force.

In the following, the invention will be described in more detail, with reference to the accompanying drawings, which as an example show an advantageous embodiment of the invention, FIG. 1 then showing schematically the mode of functioning, in principle, of the proximity fuze, FIG. 2 with the aid of a block diagram showing the mode of functioning of the transmitter unit, receiver unit and signal processing means of the proximity fuze, and FIG. 3 an alternative embodiment of the invention which comprises a control circuit.

Figure 1:
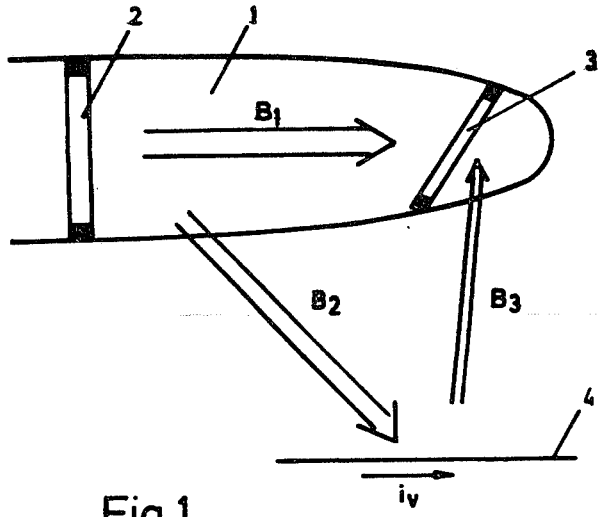

FIG. 1 shows schematically and as an example a missile 1, the front part of which is provided with a proximity fuze according to the invention. The feature which, in principle, is characteristic for the proximity fuze is that it comprises a transmitter unit in the form of a generator coil 2, which generates an electromagnetic field, which is distributed in space according to known laws. The generator coil or transmitter coil 2 is then oriented in a cross section to the missile in such a way that the field generated has its effect directed substantially forwards, the field then comprising one component in the longitudinal direction of the missile and one component at right angles to this, i.e. in the transversal direction of the missile.

Further, the proximity fuze comprises a receiver unit in the form of a sensor coil 3, which is placed at a distance from the generator coil 2, in the nose section of the missile. When the sensor coil is affected by an electromagnetic field, an electromotive force is induced in the coil.

The sensor coil can be oriented in a plane which forms a 90° angle to the longitudinal axis of the missile. The sensor coil then mainly senses objects in the longitudinal direction of the missile. However, it is also possible to place the sensor coil in a plane parallel to the longitudinal axis of the missile, and the sensor coil will then mainly sense objects in the vertical direction. In FIG. 1, the sensor coil is placed in a plane which form an angle $<90°$ to the longitudinal axis of the missile. Such a positioning can be advantageous for sensing an object obliquely forwards in the vertical direction.

A part of the electromagnetic field $B_1$ generated in the generator coil 2 falls in towards the sensor coil 3 via the missile body and gives rise to a directly induced electromotive force in the coil. If a metallic object 4 is in the vicinity of the missile, a part $B_2$ of the generated field will fall in towards the object, and an eddy current $i_v$ will then arise in the metal surface. The eddy current $i_v$ in turn gives rise to an electromagnetic interference field $B_3$, which generates an induced interference E.M.F. in the sensor coil. By separating this interference E.M.F. from the directly induced E.M.F. it is possible to detect the presence of a metallic object. The way in which the separation can be achieved will be described in more detail with reference to FIG. 2.

As will be noted from FIG. 1, the generator and sensor coils are placed at a distance from each other in the missile body. The reason for this is that the distance between the coils has an influence on the distance dependency of the proximity fuze. Too short a distance between the coils involves that the range of the proximity fuze, i.e. the distance within which an object should be in order that the proximity fuze should emit an output signal, will be altogether too short.

On the other hand, it is desirable that the distance between the coils will not be altogether too great, as metallic objects inside the missile will then dampen the part $B_1$ of the electromagnetic field which falls in directly towards the sensor coil. For reasons which will also be noted in more detail in conjunction with the description of FIG. 2, it is desired to maintain a high level of the directly induced E.M.F. Consequently, it is endeavoured, to the extent possible, to have non-metallic parts and components in the space between the two coils. Also the casing of the missile should appropriately be made of non-metallic material, for instance of plastic. As will be noted from the figure, the generator coil is circular, and is placed as near the outer casing of the missile as possible, and is surrounded only by the plastic casing.

Figure 2:
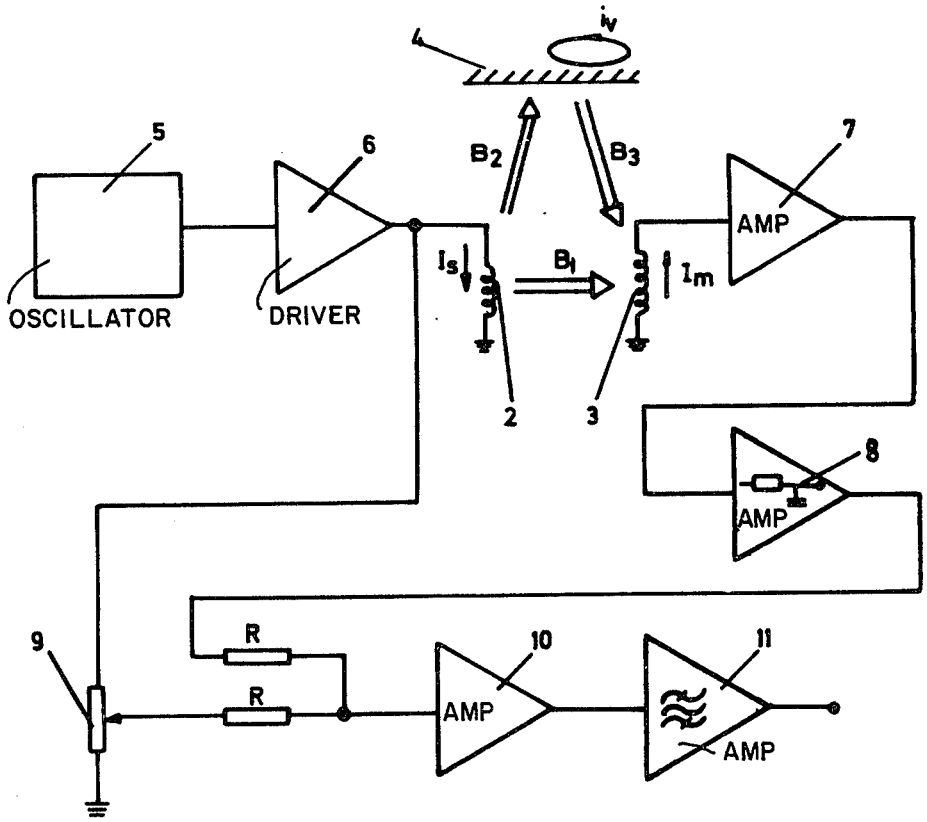

The block diagram in FIG. 2 shows the mode of functioning, in principle, of the proximity fuze. In an oscillator 5, sinusoidal oscillations with a frequency=fo are generated. A driver unit 6 provides the necessary current $I_s$ in the transmitter coil 2. The transmitter coil then generates an electromagnetic field with the frequency fo. This field is distributed in space according to known laws, and a part of the field, the component $B_1$ in the figure, falls in towards the receiver coil 3 (the sensor coil) and an induced E.M.F. is then generated in the coil. If a part of the field, the component $B_2$ in the figure falls in towards a metallic object, an eddy current $i_v$ arises in the metal surface. The eddy current $i_v$ in turn gives rise to an interference field, indicated by the component $B_3$ in the figure, which generates an induced interference E.M.F. in the receiver coil. The two E.M.F.s in the receiver coil give rise to a receiver signal Im which is amplified in amplifiers 7 and 8.

The output of the driver unit 6 is connected to an amplitude correction means in the form of a potentiometer 9 which is adjusted so that the transmitter signal in to the amplifier 10 will have the same amplitude as the receiver signal. In the amplifier 8 the phase position of the received signal is adjusted so that it will be in opposition to the output signal from the potentiometer 9. Ideally, a zero signal should then be obtained on the output of the amplifier 10. In practice, however, this is impossible, owing to the signal noise that occurs in the transmitter coil and the amplifiers 7 and 8. Likewise, there is a certain distorsion from the generated transmitter signal.

The purpose of the amplifier 11 is to limit the band width of the signal let through to a narrow frequency range $\Delta f$ centered around the transmitter frequency fo.

By means of trimming possibilities, it is possible, in practice, to balance the interference signals from all metallic objects in the vicinity of the device (e.g. the metal casing). This can be designated as a balancing for passive signals. If then an object changes position in relation to the device, the entire field picture will be changed, and an active signal will arise.

As previously mentioned, the proximity fuze is intended to act at a comparatively small distance from a metallic object. Large objects at a distance of approx. 1.2 m generate an active signal which is $<1\%$ of the direct signal. The generated signal is dependent on inter alia the size of the object, the electric conductivity, magnetic permeability, size of the object, passing speed and the transmitter frequency.

Figure 3:
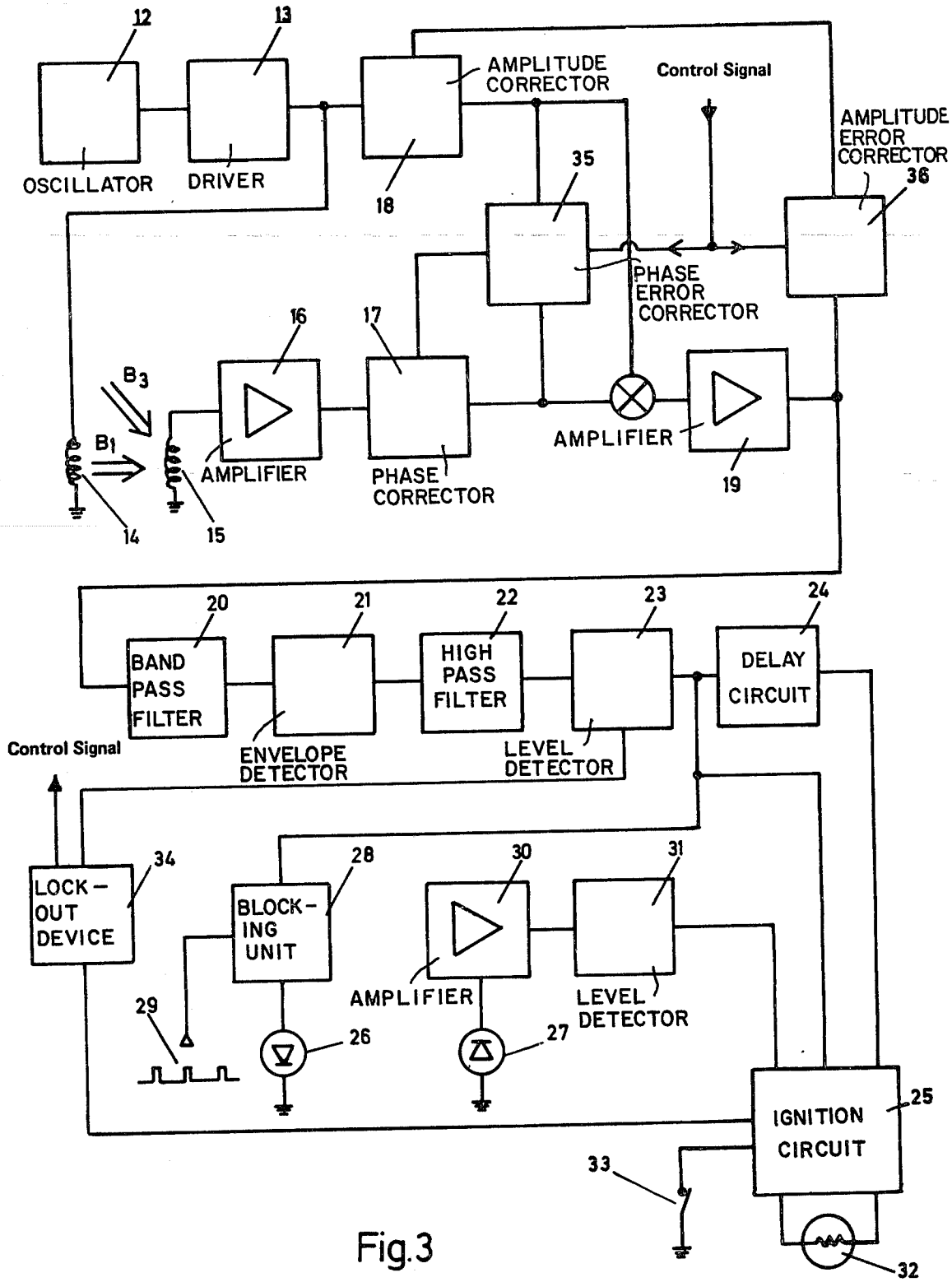

FIG. 3 shows an alternative embodiment of the invention, comprising further circuits for separating the interference signal (=the active signal). As in the case shown in FIG. 2, sinusoidal oscillations of an appropriate frequency are generated in an oscillator 12. A driver unit 13 provides the current required in the transmitter coil 14, and an electromagnetic sinusoidal varying field is then generated. A part of this field ($B_1$) induces an E.M.F. in the receiver coil 15. If a metallic object (=electrically conducting object) comes into the vicinity of the transmitter and receiver coil, in analogy with the case shown in FIG. 1, an interference E.M.F. is induced in the receiver coil 15. Normally this interference E.M.F. is small in relation to the directly induced E.M.F. and therefore the following signal processing method is appropriate for separation of the interference signal.

In a stationary condition, i.e. when only the field $B_1$ is sensed, the signal emitted from the receiver coil 15, after amplification 16 and phase correction 17 is added to the drive voltage after appropriate amplitude correction 18. Both the amplitude correction and the phase correction are preset at the production so that the output signal after a further amplifier 19 should be small (ideally=0). In practice, however, there is a certain residual signal (=rest signal). The only requirement with regard to its size is that it should not prevent the subsequent signal processing when there is a superimposed active signal. If a conducting object comes into the vicinity of the coils there will be a compound signal on the input of a band pass filter 20 consisting of the rest signal and the superimposed active signal. After band pass filtering, the signals remain, but the amount of noise and content of harmonics in the rest signal will have been dampened out.

The frequency width of the band pass filter 20 is adapted so that it will let through the amplitude modulated signal which arises if the object is allowed to pass by the coils with a certain maximum speed.

In the envelope detector 21, a frequency transformation takes place, i.e. the detector senses only signal peaks. After the detection, a signal now remains with the frequency range of $f=0$ to $f=f_{max}$ Hz, in which $f_{max}$=band width of the band pass filter. The static rest signal corresponds to the frequency $f=0$ and a slow thermal operation in this corresponds to very low frequencies.

These low frequencies are undesirable, and are filtered off in the high pass filter 22.

After this filtering, an active signal now remains, together with a certain amount of residual noise.

In the level detector 23 the active signal is compared with a predetermined threshold level, which has been fixed in such a way that the missile will be above or immediately in the vicinity of the target in question.

In order that an occasional interference pulse or the like shall not initiate the ignition circuit, an operation delay circuit 24 ($\approx 1$ ms) should appropriately be connected, the output of which is connected to the logic or the ignition circuit 25. In this way, according to the signal diagram, it will be necessary that the operating signal from the level detector occurs at least twice before the logic of the ignition circuit can react.

In order to prevent intentional interference signals from initiating the system too early, or alternatively to prevent initiation at the side of a protruding gun barrel, the proximity function should appropriately be complemented with a secondary function, e.g. a light reflection sensing function, comprising e.g. a laser diode 26 for emitting light and a detector 27 for receiving the light reflection. As will be noted from the figure, an output signal is required from the magnetic level detector 23 which releases the blocking unit 28 for the optical part. The blocking can be done either with pump pulses 29 to a chosen laser diode 26 or to amplification 30 of detected light reflection.

A third condition is hereby to be fulfilled before the ignition circuit can be finally initiated, viz. that the optical receiver shall detect one or possibly two reflected light pulses from the laser diode transmitter. The purpose of the level detector 31 connected to the receiver is to prevent any low level interference pulses from passing through.

The ignition circuit 25 is connected in a way which is known in itself to an electric igniter 32 for initiation of the charge. Further, the initiating circuit is connected with an impact contact 33, which is closed at a direct hit by the missile against a target.

At the activation of the proximity fuze electronics it is a requirement that unintentional initiation of the ignition circuit cannot take place during the building-up time of the electronics. For this purpose, a function is shown in the figure of a lock-out device 34 for both the level detector and the initiating circuit function. The lock-out device also has another function, viz. by means of control signals emitted to initiate a rapid correction of the rest signal level. The purpose of this correction is to temporarily (during approx. 20 secs.) reset the rest signal to an appopriate low level in order to eliminate any balancing errors that might arise, caused e.g. by ageing phenomena as a consequence of long-time storage.

The control signals guide the correction in two stages, the first of which consists of a phase error correction.

At this phase error correction, a possible time difference between the phase corrected sensor signal and the amplitude corrected generator voltage is appropriately detected with the aid of the phase error correction means 35. A time difference arising may be positive or negative, depending on which of said signals first goes through a zero passage. The detected time difference (=pulse width) is utilized e.g. for resistance value adjustment in the phase correction circuit 17.

At amplitude error correction, the rest signal level on the output of the amplifier 19 is compared with the aid of means 36 with an appropriately chosen voltage level, which represents the highest permissible rest signal level that may pass through the signal processing circuits.

If the rest signal level exceeds the comparison level, a correction signal is emitted to the amplitude correction circuit 18. Also in this case the correction signal is utilized for e.g. resistance value adjustment in the amplitude correction circuit.

The phase and amplitude error corrections described are carried out immediately after the building-up time of the electronics has expired. The adjusted rest signal level is thereafter maintained and is constant. The deviations which the rest signal level thereafter may be subjected to are mainly caused by temperature drift in the electronics.

Field effect transitors may appropriately be used as resistive adjusting elements in the amplitude and phase correction circuits.

The invention is not limited to the embodiments shown above as examples, but may be subject to modifications within the scope of the following claims.

I claim:

1. An electromagnetic proximity fuze for initiating the detonation of a charge in a charge carrying body when an electrically conducting object is located within a particular triggering distance of the body, the electromagnetic proximity fuze comprising:

transmitter means for generating an alternating electromagnetic field in response to a transmitter signal;

receiver means positioned in a spaced relation to said transmitter means for defining said particular triggering distance, the alternating electromagnetic field of said transmitter means directly inducing an electromotive force in the receiver means and extending to interact with said electrically conducting object to cause said object to generate an electromagnetic interference field, the electromagnetic interference field inducting an interference electromotive force in said receiver means, said interference electromotive force and said directly induced electromotive force producing a receiver signal;

signal processing means for separating the interference electromotive force associated with said electrically conducting object from the directly induced electromotive force and emitting an ignition signal for initiating the detonation of said charge in response to the separated interference electromotive force.

2. The proximity fuze of claim 1 wherein said charge carrying body includes a front nose section for retaining said transmitter means and said receiver means, the receiver means being placed in front of the transmitter means in said nose section.

3. The proximity fuze of claim 1, wherein the transmitter means includes a coil that is oriented in a cross section of the charge carrying body to direct said alternating electromagnetic field substantially in a forward direction of movement of the charge carrying body.

4. The proximity fuze of claim 3 wherein said receiver means includes at least one coil.

5. The proximity fuze of claim 1 wherein said signal processing means includes an amplitude correction means for adjusting the amplitude of the transmitter signal to substantially the same value as the amplitude of the receiver signal to detect a difference signal.

6. The proximity fuze of claim 5, including means for adjusting the phase position of the receiver signal until the amplitude of the receiver signal is in opposition to the amplitude of the adjusted transmitter signal.

7. The proximity fuze of claim 6 including control means for applying a phase error correction for the receiver signal and an amplitude error correction for said transmitter signal.

8. The proximity fuze of claim 1 including secondary proximity means for sensing light reflections, said secondary proximity means including a laser diode for emitting light and a detector for receiving the light reflected from an object in proximity to said charge carrying body.

9. The proximity fuze of claim 8 including means for detonating said charge only after said ignition signal is generated and said secondary proximity means is operated to sense reflected light.

* * * * *